US008879744B2

(12) United States Patent
Yang et al.

(10) Patent No.: US 8,879,744 B2
(45) Date of Patent: Nov. 4, 2014

(54) AUDIO TESTING SYSTEM AND AUDIO TESTING METHOD FOR DEVICE UNDER TEST

(75) Inventors: Tsung-Hao Yang, Taipei (TW); Harianto Siek, Taipei (TW); Shao-Tang Wang, Taipei (TW)

(73) Assignee: Inventec Corporation, Taipei (TW)

( * ) Notice: Subject to any disclaimer, the term of this patent is extended or adjusted under 35 U.S.C. 154(b) by 457 days.

(21) Appl. No.: 13/343,229

(22) Filed: Jan. 4, 2012

(65) Prior Publication Data

US 2013/0142346 A1 Jun. 6, 2013

(30) Foreign Application Priority Data

Dec. 5, 2011 (TW) ..... 100144637 A

(51) Int. Cl.
*H04R 29/00* (2006.01)

(52) U.S. Cl.
USPC ..... 381/58; 381/59; 381/60

(58) Field of Classification Search
USPC ..... 381/58–60, 56; 324/112, 113, 123 R, 324/123 C, 124
See application file for complete search history.

(56) References Cited

U.S. PATENT DOCUMENTS

2007/0286429 A1* 12/2007 Grafenberg et al. ..... 381/60
2009/0116656 A1* 5/2009 Lee et al. ..... 381/59
2012/0195437 A1* 8/2012 Van den Heuvel et al. ..... 381/60
2013/0243210 A1* 9/2013 Roeck et al. ..... 381/60

* cited by examiner

*Primary Examiner* — Vivian Chin
*Assistant Examiner* — David Ton
(74) *Attorney, Agent, or Firm* — CKC & Partners Co., Ltd.

(57) ABSTRACT

An audio testing system and an audio testing method for an electronic device under test are provided. The audio testing method includes the following steps. A testing audio is sent through a testing audio sending end of a testing device. An electronic device under test is controlled to perform recording through an audio receiving end, so as to generate an under-testing audio. After the recording is completed, the device under test controlled to playback the under-testing audio from one of both-side audio sending ends to perform recording through the testing audio receiving end, and calls an audio analyzing process to generate a first testing result. The device under test controlled to playback the under-testing audio from the other one of the both-side audio sending ends to perform recording through the testing audio receiving end, and calls the audio analyzing process to generate a second testing result.

8 Claims, 4 Drawing Sheets

AUDIO TESTING SYSTEM AND AUDIO TESTING METHOD FOR DEVICE UNDER TEST

CROSS-REFERENCE TO RELATED APPLICATION

This application claims the priority benefit of Taiwan application serial no. 100144637, filed on Dec. 5, 2011. The entirety of the above-mentioned patent application is hereby incorporated by reference herein and made a part of this specification.

BACKGROUND OF THE INVENTION

1. Field of the Invention

The present invention generally relates to a testing technique, in particular, to an audio testing system and an audio testing method for an electronic device under test.

2. Description of Related Art

For manufacturers, how to detect a tone quality of a portable electronic device (for example, an audio playback device such as a notebook computer, a cell phone, and a tablet) on a production line is always an important issue. In order to ensure the audio quality of products thereof, the manufacturers perform various detections on audio loops of the products, and the detections include measuring the following items of the audio loop, including frequency response, total harmonic distortion+noise (THD+N), signal to noise ratio (SNR), 2 channel ratio, corsstalk, and output waveform. Audio properties of the products are detected according to the detections.

However, in the prior art, the manufacturers need to purchase many complicated and expensive instruments to perform testing on the audio playback devices, which not only causes the increase of manufacturing cost, but has a complicated and time-consuming operation, and is not suitable to be performed on the production line. As for the current audio testing manner, a part of the testing content needs to be judged by human ear of testers, and noises on the production line always disturbs other testers nearby. Therefore, the manner of recognizing the audio with human ears does not have a unified standard and is easy to generate large error, so it is hard to avoid misjudgement of the testers.

SUMMARY OF THE INVENTION

Accordingly, the present invention is directed to an audio testing system and a testing method for an electronic device under test, which may be automatically performed during audio testing, without the need of judging the content of audio testing through human ears, thereby avoiding complicated detection steps and details, reducing faults of manual testing, and avoiding misjudgement of testers.

The present invention provides an audio testing system, which includes a testing device and an electronic device under test. The testing device includes a testing audio sending end and a testing audio receiving end. The device under test includes an audio receiving end and both-side audio sending ends. The testing device sends a testing audio through the testing audio sending end, and controls the device under test to perform recording through the audio receiving end, so as to generate an under-testing audio. After the recording is completed, the testing device controls the device under test to playback the under-testing audio from one of the both-side audio sending ends, so that the testing device performs recording through the testing audio receiving end, and calls an audio analyzing process to generate a first testing result. Moreover, the testing device controls the device under test to playback the under-testing audio from the other one of the both-side audio sending ends, so that the testing device performs recording through the testing audio receiving end, and calls the audio analyzing process to generate a second testing result.

In another aspect, the present invention provides an audio testing method for an electronic device under test, which includes the following steps. A testing audio is sent through a testing audio sending end of a testing device. The device under test is controlled to perform recording through an audio receiving end, so as to generate an under-testing audio. After the recording is completed, the device under test is controlled to playback the under-testing audio from one of both-side audio sending ends, so as to perform recording through a testing audio receiving end of the testing device, and call an audio analyzing process to generate a first testing result, and the device under test is controlled to playback the under-testing audio from the other one of the both-side audio sending ends, so as to perform recording through the testing audio receiving end, and call the audio analyzing process to generate a second testing result.

In view of the above, the present invention provides an audio testing system and a testing method for an electronic device under test. The testing device in this embodiment sends the testing audio, and the testing device may control the device under test to perform recording through the audio receiving end to generate the under-testing audio. After the recording is completed, the testing device may control the device under test to playback the under-testing audio, and record the received corresponding audio through the testing audio receiving end of the testing device, and generate testing results through the audio analyzing process. Therefore, the audio testing system and the method thereof may replace the method of performing audio testing by listening through human ears on the production line, and a dedicated jig is used to avoid noise interference on the production line. In this way, the efficiency of audio testing of the device under test may be improved, and possible misjudgment during the testing may be reduced.

In order to make the above features and advantages of the present invention more comprehensible, embodiments are illustrated in detail below through accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
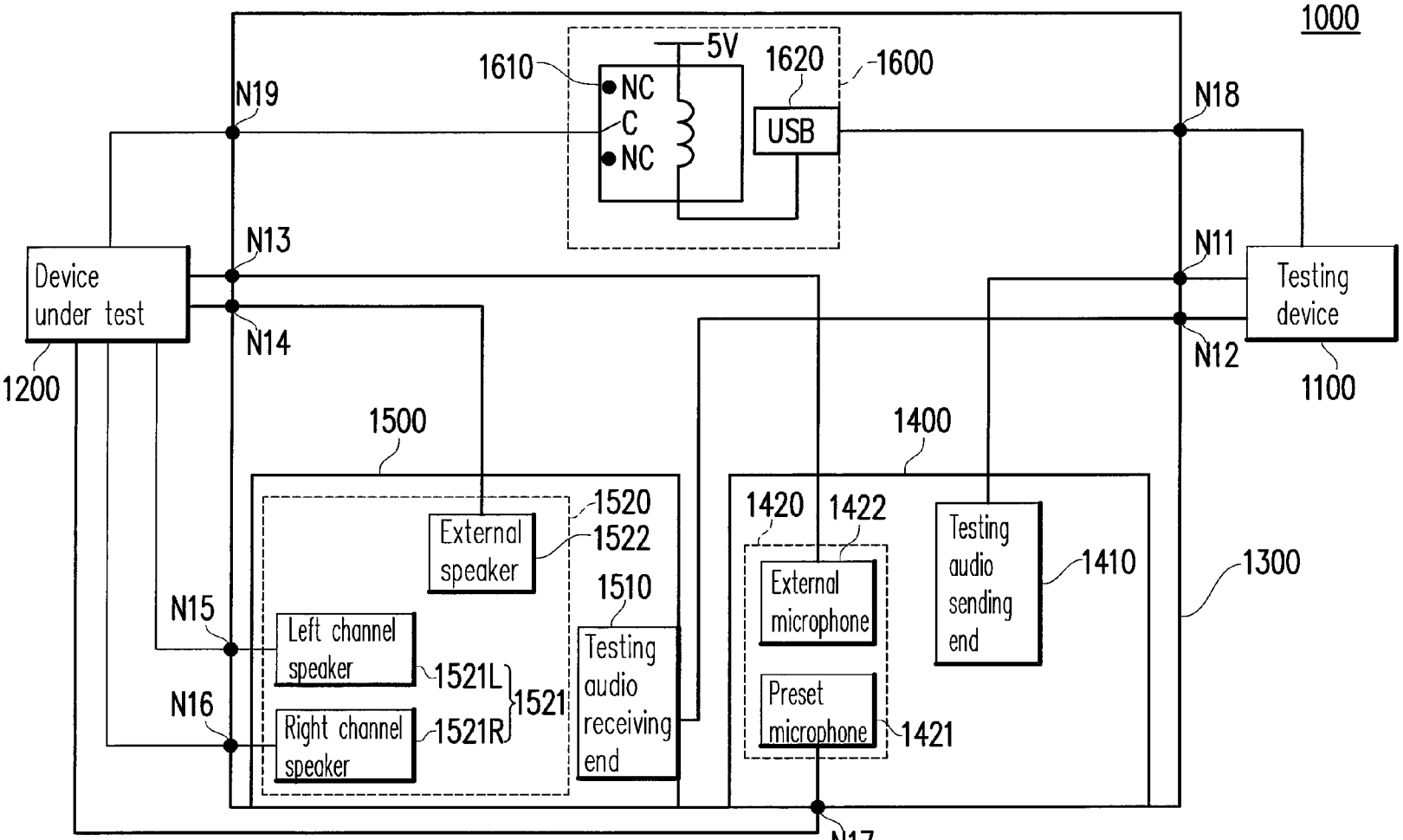
FIG. 1 is a block diagram of an audio testing system according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a block diagram of an audio testing system 1000 according to an embodiment of the present invention. Referring to FIG. 1, the audio testing system 1000 provided in the present invention includes a testing device 1100, an electronic device under test 1200, a jig 1300, and an interface circuit 1600. The testing device 1100 includes a testing audio sending end 1410 and a testing audio receiving end 1510. The device under test 1200 includes an audio receiving end 1420 and both-side audio sending ends 1520. The interface circuit 1600 includes a testing switch 1610 and a universal serial bus (USB) interface 1620.

During the implementation, the audio testing system 1000 mainly tests the device under test 1200 that cannot loopback the audio testing. It is difficult to write a software program on an operating platform of the device under test 1200 to detect audio devices thereof, in other words, it is difficult for the device under test 1200 to connect an audio receiving end (a microphone) and an audio sending end (for example, a speaker) thereof, and perform detection automatically by using a software program. Therefore, the device under test 1200 in this embodiment is, for example, a tablet, a smart phone, or a notebook that has a special operating platform. In this embodiment, the device under test 1200 is, for example, a major circuit device in the tablet. Correspondingly, it is required to perform the audio testing method confirming to the spirit of this embodiment on the testing device 1100, so the testing device 1100 may be a computer device having a universal operating platform (for example, a windows operating system, or LINUX operating system).

On the other hand, in order to provide a noise-proof detection environment, a dedicated jig 1300 especially used for the audio testing system 1000 is developed in this embodiment, the jig 1300 includes sound boxes 1400, 1500 and an interface circuit 1600, where the interface circuit 1600 is a circuit device integrating the USB interface 1620 and the testing switch 1610. Therefore, a tester may configure the testing audio sending end 1410 and the testing audio receiving end 1510 of testing device 1100, the audio receiving end 1420 and the both-side audio sending ends 1520 of the device under test 1200, on the jig 1300 according to corresponding terminals, so as to perform audio transmission in the audio testing. Specifically, the testing audio sending end 1410 of the testing device 1100 and the audio receiving end 1420 of the device under test 1200 are configured in the same sound box 1400, and the testing audio receiving end 1510 of the testing device 1100 and the both-side audio sending ends 1520 of the device under test 1200 are configured in the other sound box 1500. In addition, the jig 1300 has a plurality of terminals N11-N19, so as to couple the testing device 1100 and the device under test 1200.

Referring to FIG. 1, the testing device 1100 is coupled to the testing audio sending end 1410 in the sound box 1400 through a terminal N11 on the jig 1300, and is coupled to the testing audio receiving end 1510 in the sound box 1500 through a terminal N12 on the jig 1300. The testing audio sending end 1410 may send a testing audio to serve as an audio signal for testing, and the testing audio receiving end 1510 may perform recoding to an under-testing audio. The testing device 1100 (computer) in this embodiment may include a testing process confirming to the audio testing method of this embodiment, and an audio analyzing process.

The testing process includes a user interface, and during the procedure of the audio testing, a user may input parameters, such as a designated testing audio, for audio testing through the user interface, so that the testing process performs the testing. That is to say, the testing process enables the testing device 1100 to send the audio signal for testing through the testing audio sending end 1410, and control the device under test 1200 to send an audio signal, so that the audio signal sent by the device under test 1200 is recorded by the testing audio receiving end 1510. After the recording is completed, the testing process will call the audio analyzing process to generate a testing result, and display, through the user interface, a message about the testing result, for example, alarm messages such as "L_PASS" for passing the left channel part of under-testing audio, "L_FAIL" for failing to pass the left channel part of under-testing audio, "R_PASS" for passing the right channel part of under-testing audio, and "R_FAIL" for failing to pass the right channel part of under-testing audio.

The audio analyzing process may perform various different audio detecting flows, and the audio detecting flows may be, for example, measuring frequency response, output power, SNR of the audio loop, so as to obtain the situation of the under-testing system accordingly. For example, the measuring the frequency response is used for detecting a ratio of an input signal and an output signal of the audio loop, that is to say, detecting magnitudes of energies responded in various stages of the audio loop, that is, detecting gain properties of various signals. Therefore, by using the testing process and the audio analyzing process provided by the testing device, audio judgment of human ears may be replaced to perform audio testing, and the highest working frequency, the lowest working frequency, and the gain situations of the audio loop may be obtained through the audio analyzing process.

The audio receiving end 1420 of the device under test 1200 may include a preset microphone 1421 built in the tablet and an external microphone 1422. The both-side audio sending ends 1520 of the device under test 1200 may include a preset speaker 1521 built in the tablet and an external speaker 1522, and preset speaker 1521 includes a left channel speaker 1521L and a right channel speaker 1521R. Audio loops received by the preset microphone 1421 built in the device under test 1200 and the external microphone 1422 may be different, and likewise, the preset speaker 1521 built in the device under test 1200 and the external speaker 1522 may also have different audio loops, so they all need the audio testing method described in this embodiment. In this embodiment, the preset microphone 1421 and the preset speaker 1521 are detected at the same time, so the two are referred to as a preset audio system. On the other hand, in this embodiment, the external microphone 1422 and the external speaker 1522 are detected at the same time, so they are referred to as an external audio system. Therefore, the audio testing system 1000 of this embodiment performs the audio testing of two different states on the device under test 1200, respectively being an audio testing for the preset audio system and an audio testing for the external audio system.

More specifically, the device under test 1200 is coupled to the audio receiving end 1420 in the sound box 1400 respectively through terminals N13 and N17 on the jig 1300, that is, coupled to the preset microphone 1421 and the external microphone 1422 of the preset audio receiving end 1420, so that the device under test 1200 may record the testing audio sent by the testing device 1100 in the sound box 1400 on the jig 1300, so as to generate the under-testing audio. Moreover, the device under test 1200 is coupled to the both-side audio sending ends 1520 in the sound box 1500 through terminals N14-N16 on the jig 1300. More specifically, the device under test 1200 is coupled to the left channel speaker 1521L and the right channel speaker 1521R of the preset speaker 1521 respectively through the terminal N15 and the terminal N16, and the device under test 1200 is coupled to the external speaker 1522 through the N14, in this way, the device under test 1200 is enabled to playback, in the sound box 1500, the under-testing audio recorded by the device under test 1200 through the audio receiving end 1420.

Moreover, the device under test 1200 of this embodiment also includes an under-testing end process, which communicates with the testing process and is controlled by the testing process. Therefore, the testing process controls, through the under-testing end process, a number of playback times of the both-side audio sending ends 1520 of the device under test 1200, and the under-testing end process may also send the audio state of the device under test 1200 to the testing process. For example, the device under test 1200 may send a message, such as, "AutoLoopbackExternalTest begin", "AutoLoopbackIn ternalTest begin", "Start playing left channel", "Start playing left channel", to the under-testing end process of the testing device 1100.

The testing switch 1610 is configured in the jig 1300, and the testing switch 1610 in this embodiment is, for example, a relay. Moreover, the testing device 1140 may remote-control the state of the testing switch 1610 through the USB interface 1620, and the testing switch 1610 and the USB interface 1620 are electrically connected to the device under test 1200 through a terminal N18 on the jig 1300. In addition, the testing switch 1610 may control the conduction of the internal circuit of the testing switch 1610 by setting the magnitude of a voltage, so as to have the function of switching the switch. Further, the testing switch 1610 is connected to the device under test 1200 through a terminal C thereof and a terminal N19 of the jig 1300.

The audio testing of the device under test 1200 includes audio testing of two different states (for the preset audio system and the external audio system), and therefore, the switching of the testing switch 1610 may control the switching of the testing states of the preset audio system and the external audio system of the device under test 1200. In other words, during the audio testing, the testing switch 1610 may simulate that the device under test 1200 has or has not detected the external microphone 1422 and the external speaker 1522, so that the device under test 1200 switches the preset audio system or the external audio system, so as to test the preset microphone 1421, the preset speaker 1521, the external microphone 1422 and the external speaker 1522 sequentially.

For example, when the testing switch 1610 is in the first state, for example, simulates that the device under test 1200 does not detect the external speaker 1522, the audio testing system 1000 accordingly tests the preset audio system of the device under test 1200. On the contrary, when the testing switch 1610 is in the second state, for example, simulates that the device under test 1200 has detected the external microphone 1422 and external speaker 1522, the audio testing system 1000 may be enabled to test the external audio system of the device under test 1200. Therefore, through the testing switch 1610, the audio testing system 1000 of this embodiment may enable the testing device 1100 to automatically control the switch of testing states of the preset audio system and the external audio system through the testing process, thereby avoiding manual switching of the testing states, reducing the time of testing flow, and improving the efficiency of the test.

Figure 2:
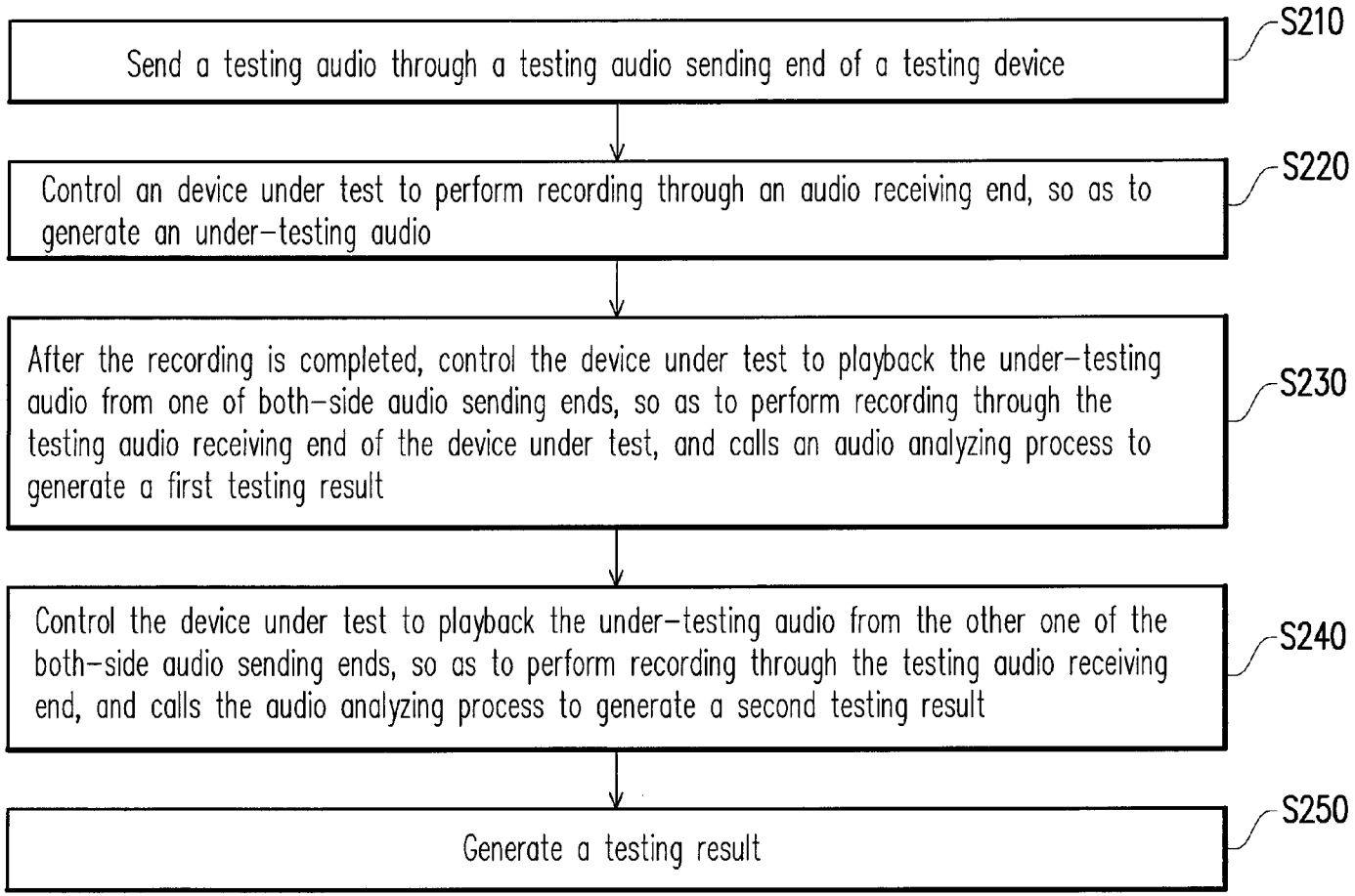
FIG. 2 is a flow chart of an audio testing method according to an embodiment of the present invention.
Figure 3:
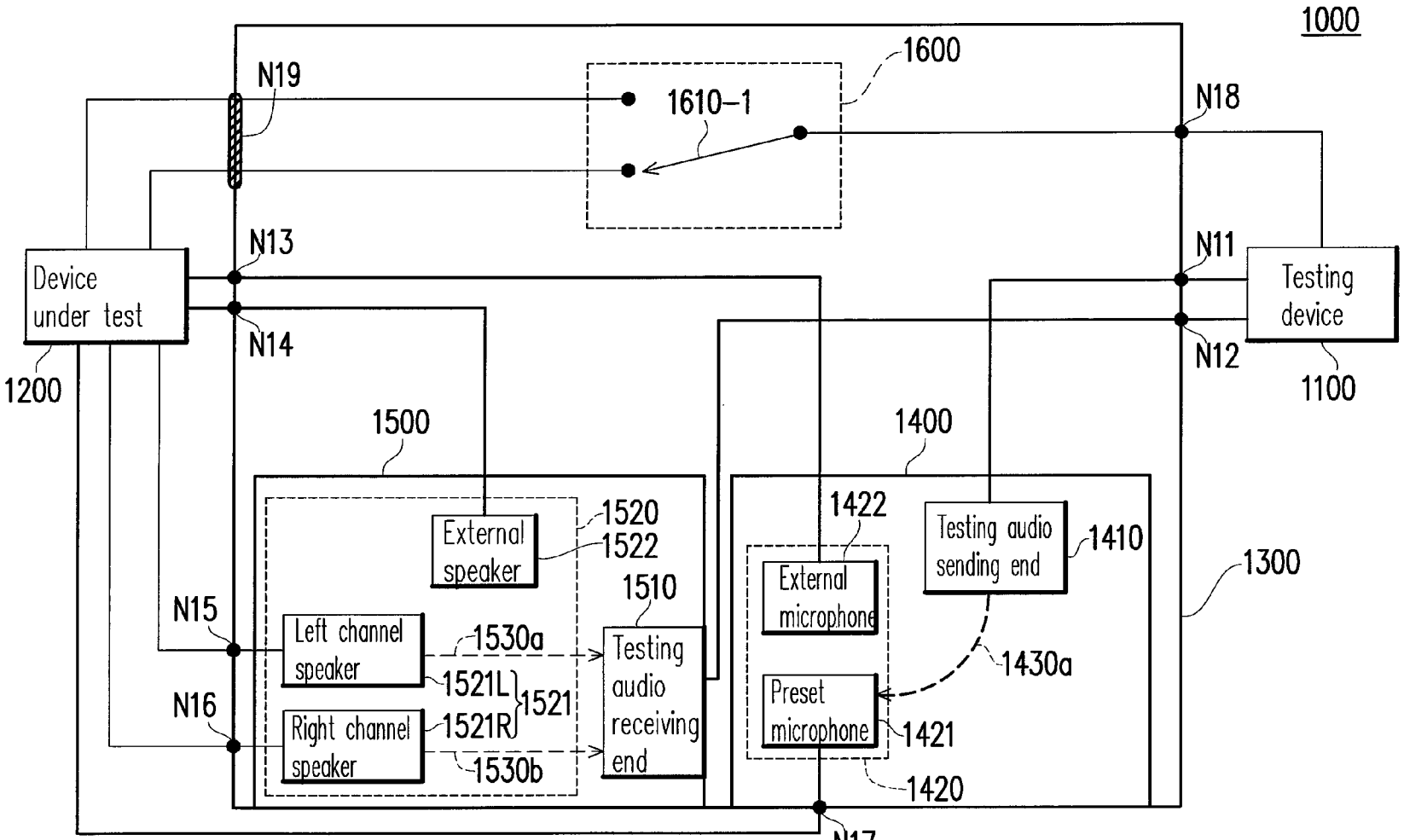
FIG. 3 is a block diagram of an audio testing system according to an embodiment of the present invention.

Respective steps of the audio testing method are illustrated below in accompanying with the audio testing system 1000. FIG. 2 is a flow chart of an audio testing method according to an embodiment of the present invention. FIG. 3 is a schematic view of an audio testing system 1000 according to an embodiment of the present invention. In this embodiment, audio testing on the preset audio system and the audio testing on the external audio system of the device under test 1200 are performed in sequence according to the step flows in FIG. 2.

Referring to FIG. 2 and FIG. 3 at the same time, it is assumed that the testing switch 1610 in the audio testing system 1000 is in the first state (as shown by an arrow 1610-1), that is to say, the audio testing system 1000 is used for detecting the preset audio system of the device under test 1200 at this time. In step S210, the testing process in the testing device 1100 performs the audio testing according to audio testing parameters input or designated by the user, and enables the testing device 1100 to send a testing audio through the testing audio sending end 1410. In step S220, the testing process controls the under-testing end process of the device under test 1200, so as to perform recording through the preset microphone 1421 of the device under test 1200 to generate an internal under-testing audio. In other words, a dashed arrow 1430*a* shown in FIG. 3 indicates a transmission direction of the testing audio, that is, the testing audio sending end 1410 sends the testing audio, and the preset microphone 1421 receives the testing audio to perform recording to generate the internal under-testing audio.

After the recording is completed, step S230 is performed, in which the testing process controls the device under test 1200 to playback the left channel part of the internal under-testing audio from the left channel speaker 1521L, so as to perform recording through the testing audio receiving end 1510, and call the audio analyzing process in the testing device 1100 to generate the first testing result. The dashed arrow 1530*a* shown in FIG. 3 indicates a transmission direction of the left channel part of the internal under-testing audio. That is to say, the left channel part of the internal under-testing audio of the device under test 1200 is played back by the left channel speaker 1521L and is received by the testing audio receiving end 1510 to perform recording, and the internal preset audio sent by the device under test 1200 through a left channel loop is analyzed through the audio analyzing process in the testing device 1100, so as to generate the first testing result. More specifically, after the testing process receives the first testing result generated by the audio analyzing process, the testing process may display, according to the first testing result, a message of "L_PASS" or "L_FAIL". Moreover, if the testing result is the "L_FAIL", the device under test 1200 may playback the internal under-testing audio repeatedly according to the under-testing end process, until the testing result of "L_PASS" appears, or when a preset number of playback loop is reached, the testing process automatically stops and displays the testing result as failed.

Then, similar to step S230, in step S240, the testing process controls the device under test 1200 to playback the right channel part of the internal under-testing audio from the right channel speaker 1521R, so as to perform recording through the testing audio receiving end 1510, and call the audio analyzing process in the testing device 1100 to generate the second testing result. The dashed arrow 1530*b* shown in FIG. 3 indicates a transmission direction of the right channel part of the internal under-testing audio, that is, the right channel part of the internal under-testing audio of the device under test 1200 is played back by the right channel speaker 1521R and is received by the testing audio receiving end 1510 to perform recording, and the right channel part of the internal under-testing audio is analyzed through the audio analyzing process in the testing device 1100, that is, detecting a right channel loop of the device under test 1200, so as to generate the second testing result. The device under test 1200 may playback the internal under-testing audio repeatedly according to the under-testing end process, until the testing result of "R_PASS" appears, or when the preset number of playback loop is reached, the testing process automatically stops and displays the testing result as failed.

In step S250, if the first testing result and the second testing result generated by the audio analyzing process are all passed, the user interface displays a pass message, for example "PASS". However, if the first testing result or the second testing result generated by the audio analyzing process is failure, the user interface displays a failure message, for example "FAIL".

Figure 4:
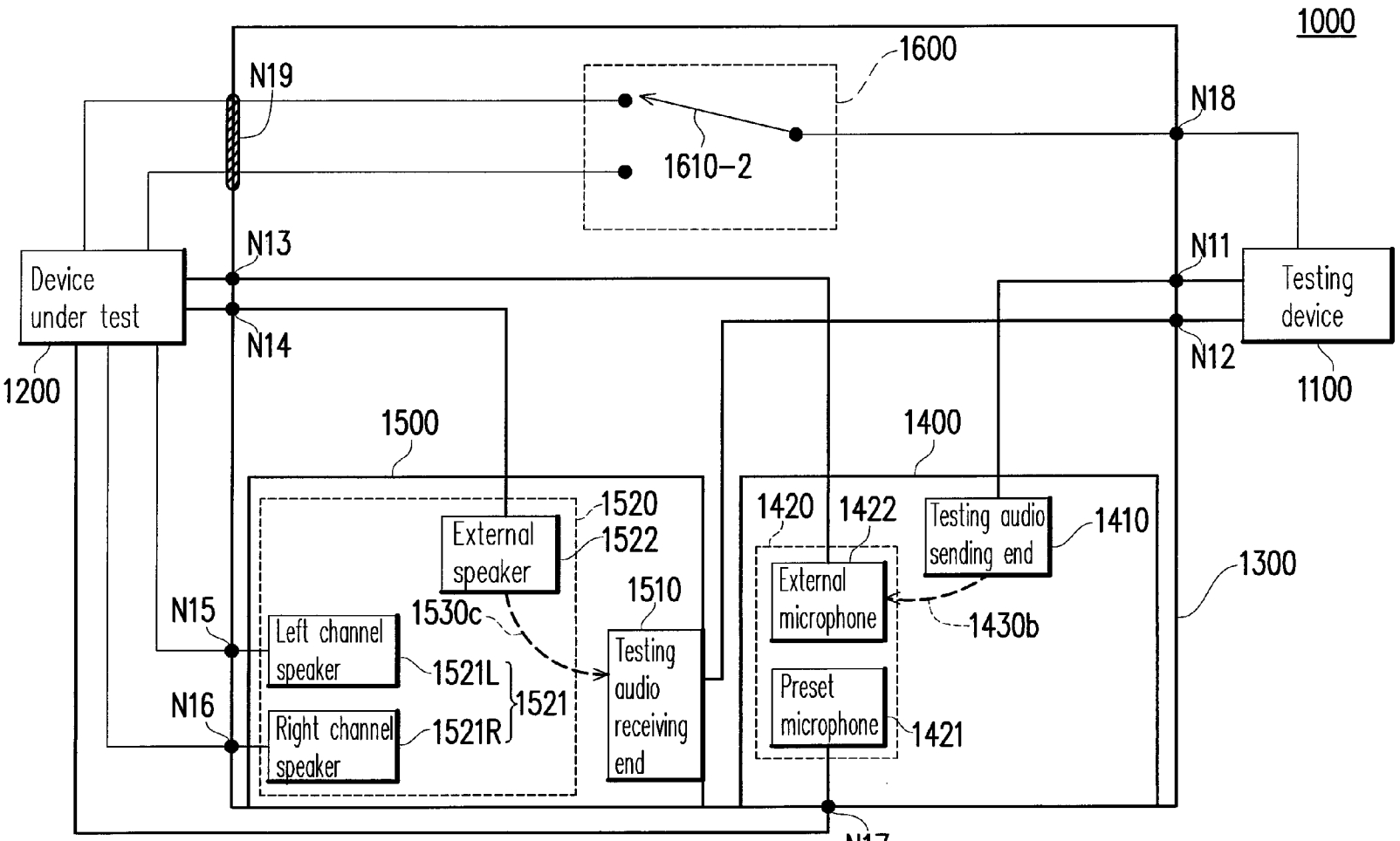
FIG. 4 is a block diagram of an audio testing system according to an embodiment of the present invention.

FIG. 4 is a block diagram of an audio testing system 1000 according to an embodiment of the present invention. Referring to FIG. 2 and FIG. 4 at the same time, it is assumed that the testing switch 1610 in the audio testing system 1000 is of the second state (as shown by an arrow 1610-2), that is to say, the audio testing system 1000 is used for testing the external audio system of the device under test 1200 at this time. The step flow for testing the external audio system of the device under test 1200 is similar to that for testing the preset audio system, and can be integrated into steps S210-S250, so this embodiment omits the illustration of the same technical solutions.

The difference between this embodiment and the previous embodiment lies in that: in the step S220, the testing process in the testing device 1100 controls the under-testing end process of the device under test 1200, so as to perform recording through the external microphone 1422 of the device under test 1200 to generate an external under-testing audio. In other words, the dashed arrow 1430*b* shown in FIG. 4 indicates a transmission direction of the testing audio, that is, the testing audio sending end 1410 sends the testing audio, and the external microphone 1422 receives the testing audio and performs the recording. After the recording is completed, step S230 is performed, in which the testing process controls the device under test 1200 to playback the external under-testing audio from a left channel part of the external speaker 1522, so as to perform the recording through the testing audio receiving end 1510, and call the audio analyzing process in the testing device 1100 to generate the first testing result. The dashed arrow 1530*c* shown in FIG. 4 indicates a transmission direction of the left channel part of the external under-testing audio, that is, the left channel part of the external under-testing audio of the device under test 1200 is played back by the external speaker 1522 and is received by the testing audio receiving end 1510 to perform recording, and the left channel part of the external under-testing audio is analyzed through the audio analyzing process in the testing device 1100, that is, detecting a left channel loop of the external audio system of the device under test 1200, so as to generate the first testing result. Then, similar to step S230, in the step S240, the testing process controls the device under test 1200 to playback the right channel part of the external under-testing audio from the external speaker 1522, so as to perform recording through the testing audio receiving end 1510, and call the audio analyzing process in the testing device 1100 to generate the second testing result. In other words, due to the function of the external speaker 1522 of switching the playback of the left/right channel, the dashed arrow 1530*c* shown in FIG. 4 indicates a transmission direction of the right channel part of the external under-testing audio, that is, the right channel part of the external under-testing audio of the device under test 1200 is played back by the external speaker 1522 and is received by the testing audio receiving end 1510 to perform the recording, and the right channel part of the external under-testing audio is analyzed through the audio analyzing process in the testing device 1100, that is, detecting a right channel loop of the device under test 1200, so as to generate the second testing result. In step S250, if the first testing result and the second testing result generated by the audio analyzing process are all passed, the user interface displays a pass message, indicating that the external audio system of the device under test 1200 passes the test. If the first testing result or the second testing result generated by the audio analyzing process is failure, the user interface displays a failure message, indicating that the of the external audio system device under test 1200 fails to pass the test.

In view of the above, an audio testing system and a testing method for an electronic device under test are provided in the present invention, a testing device may be used to sent a testing audio to perform each audio testing, thereby avoiding complicated detecting steps and details during the audio testing, and automatically controlling the switch of testing states of the preset audio system and the external audio system of the device under test through the testing process. Therefore, the audio testing system and the method thereof may replace the method of performing audio testing by listening through human ears on the production line, and a dedicated jig is used to avoid noise interference on the production line. In this way, the efficiency of audio testing of the device under test may be improved, and possible misjudgment during the testing may be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An audio testing system for testing an electronic device, comprising:

a testing device, comprising a testing audio sending end and a testing audio receiving end; and an electronic device under test, comprising an audio receiving end and both-side audio sending ends, wherein, the testing device sends a testing audio through the testing audio sending end, and controls the device under test to perform recording through the audio receiving end so as to generate an under-testing audio, after the recording is completed, the testing device controls the device under test to playback the under-testing audio from one of the both-side audio sending ends, so that the testing device performs recording through the testing audio receiving end, and calls an audio analyzing process to generate a first testing result, moreover, the testing device controls the device under test to playback the under-testing audio from the other one of the both-side audio sending ends, so that the testing device performs recording through the testing audio receiving end, and calls the audio analyzing process to generate a second testing result, the audio receiving end of the device under test comprises a preset microphone and an external microphone, the both-side audio sending ends comprises a preset speaker and an external speaker, and, the audio testing system further comprises:

a testing switch, for simulating that the device under test has or has not detected the external speaker, so as to switch the audio receiving end and the both-side audio sending ends of the device under test.

2. The audio testing system according to claim 1, wherein the device under test is a tablet, a smart phone, or a notebook computer.

3. The audio testing system according to claim 1, wherein the testing device sets the testing switch as a first state, sends the testing audio through the testing audio sending end, and controls the device under test to performing recording through the preset microphone to generate an internal under-testing audio, after the recording is completed, the testing device controls the device under test to playback a left channel part of the internal under-testing audio from the preset speaker, so that the testing device performs recording through the testing audio receiving end, and calls the audio analyzing process to generate the first testing result; and the testing device controls the device under test to playback a right channel part of the internal under-testing audio from the preset speaker, so that the testing device performs recording through the testing audio receiving end, and calls the audio analyzing process to generate the second testing result.

4. The audio testing system according to claim 1, wherein the testing device sets the testing switch as a second state, sends the testing audio through the testing audio sending end, and controls the device under test to perform recording through the external microphone to generate an external under-testing audio, after the recording is completed, the testing device controls the device under test to playback a left channel part of the external under-testing audio from the external speaker, so that the testing device performs recording through the testing audio receiving end, and calls the audio analyzing process to generate the first testing result; and the testing device controls the device under test to playback a right channel part of the external under-testing audio from the external speaker, so that the testing device performs recording through the testing audio receiving end, and calls the audio analyzing process to generate the second testing result.

5. The audio testing system according to claim 1, wherein when the first testing result and the second testing result are all pass, the testing device displays a pass message, and when the first testing result or the second testing result is failure, the testing device displays a failure message.

6. An audio testing method for an electronic device under test, comprising:

sending a testing audio through a testing audio sending end;

controlling the device under test to perform recording through an audio receiving end, so as to generate an under-testing audio;

after the recording is completed, controlling the device under test to playback the under-testing audio from one of both-side audio sending ends, so as to perform recording through a testing audio receiving end, and call an audio analyzing process to generate a first testing result; and controlling the device under test to playback the under-testing audio from the other one of the both-side audio sending ends, so as to perform recording through the testing audio receiving end, and call the audio analyzing process to generate a second testing result, wherein the audio receiving end of the device under test comprises a preset microphone and an external speaker, and, the audio testing method further comprises:

simulating, through a testing switch, that the device under test has or has not detected the external speaker, so as to switch the audio receiving end and the both-side audio sending ends of the device under test.

7. The audio testing method according to claim 6, further comprising:

setting the testing switch as a first state;

sending the testing audio through the testing audio sending end;

controlling the device under test to perform recording through the preset microphone, so as to generate an internal under-testing audio;

after the recording is completed, controlling the device under test to playback a left channel part of the internal under-testing audio from the preset speaker, so as to perform recording through the testing audio receiving end, and call the audio analyzing process to generate the first testing result; and controlling the device under test to playback a right channel part of the internal under-testing audio through the preset speaker, so as to perform recording through the testing audio receiving end, and call the audio analyzing process to generate the second testing result.

8. The audio testing method according to claim 6, further comprising:

setting the testing switch as a second state;

sending the testing audio through the testing audio sending end;

controlling the device under test to perform recording through the external microphone, so as to generate an external under-testing audio;

after the recording is completed, controlling the device under test to playback a left channel part of the external under-testing audio from a left channel part of the external speaker, so as to perform recording through the testing audio receiving end, and call the audio analyzing process to generate the first testing result; and controlling the device under test to playback a right channel part of the external under-testing audio from a right channel part of the external speaker, so as to perform recording through the testing audio receiving end, and call the audio analyzing process to generate the second testing result.

* * * * *